United States Patent [19]

Goosen

[11] 4,420,438

[45] Dec. 13, 1983

[54] CARBURETOR THROTTLE VALVE METHOD AND APPARATUS

[76] Inventor: Carl C. Goosen, Rte. 3, Box 1250, Palomino Way, Oviedo, Fla. 32765

[21] Appl. No.: 328,860

[22] Filed: Dec. 9, 1981

[51] Int. Cl.[3] ..... F02M 9/08

[52] U.S. Cl. ..... 261/65; 251/305

[58] Field of Search ..... 261/65; 251/305

[56] References Cited

U.S. PATENT DOCUMENTS

| | | | |
|---|---|---|---|
| 1,706,020 | 3/1929 | Barfoed | 251/305 |
| 2,139,841 | 12/1938 | Mennesson | 261/65 |
| 2,271,390 | 1/1942 | Dodson | 261/65 |
| 2,680,592 | 6/1954 | Zierer | 261/65 |
| 2,994,517 | 8/1961 | Fenton | 261/65 |
| 3,074,421 | 1/1963 | Borcherdt | 251/305 |
| 3,606,980 | 9/1971 | Simpson et al. | 251/305 |
| 3,778,038 | 12/1973 | Eversole et al. | 261/34 A |
| 3,814,389 | 6/1974 | August | 261/65 |
| 3,903,215 | 9/1975 | Cole et al. | 261/65 |
| 4,064,847 | 12/1977 | Holzbaur et al. | 123/455 |
| 4,079,713 | 3/1978 | Leprade et al. | 261/44 C |
| 4,079,718 | 3/1978 | Holzbaur | 261/50 A |

OTHER PUBLICATIONS

J. C. Whitney Catalogue, p. 188, Apr. 1981.

*Primary Examiner*—Tim R. Miles

*Attorney, Agent, or Firm*—William M. Hobby, III

[57] ABSTRACT

Carburetor throttle valve apparatus for an internal combustion engine and a method of modifying a carburetor throttle valve are provided. The apparatus includes a pair of spherical segments with center openings for attaching to either side of the existing throttle plate and throttle shaft. The segments are grooved on one side to fit the throttle shaft and once attached, the throttle valve has a generally lenticular shape acting as an air foil to prevent excessive turbulence and recondensation of atomized fuel. A method of attaching the throttle valve includes removing a portion of the carburetor, attaching a jig, drilling an aperture for the attachment of the added throttle plates, making the spherical segments and attaching the segments to the existing throttle and reattaching the carburetor to the engine.

4 Claims, 4 Drawing Figures

CARBURETOR THROTTLE VALVE METHOD AND APPARATUS

BACKGROUND OF THE INVENTION

The present invention relates to carburetor for internal combustion engines and especially to an improved throttle valve and method of attaching an improved throttle valve to an existing carburetor.

In a typical internal combustion engine, hydrocarbon fuel and air are mixed and metered in a carburetor on the intake manifold of the engine. Each engine has a carburetor tailored to the individual engine requirements, but most carburetors operate in the same manner. Most carburetors have fixed venturies, even though a few engines utilize variable venturi carburetors and many engines use fuel injection for direct injection of the fuel into the combustion chamber. In a typical carburetor, the hydrocarbon fuel is supplied by a pump to a float controlled reservoir. During cruise conditions, fuel is drawn through jets by the pressure drop created by the increased velocity of the air flow through the venturi. This air flow is normally controlled by a butterfly or throttle plate valve. During other phases of operation, such as idle, acceleration, deceleration, various other mechanisms come into play, such as idle jets, acceleration pumps and power valves. These functions are controlled by changes in manifold and venturi vacuum valves. Carburetor designs are aimed at smoothing out transition between these various operating conditions to eliminate stumbling, hesitation and excessive lean or rich spot fuel delivery. The overall result is still far from ideal, in that there is still too much unused fuel. When atomized fuel reaches the throttle valve plate in normal driving range, the slope of the plate across the throat causes uneven distribution. Most of the fuel, including idle port and transfer slots supplies, and about half of the air, flow through the lower throttle opening while considerably less fuel and about half of the air goes through the upper throttle opening. This poor mixing arrangement is never corrected, so that when the engine is under heavy load or rapid acceleration, fuel is wasted. As the manifold vacuum falls, air flow velocity decreases through the venturi causing larger fuel drops to be formed thereby decreasing the effectiveness of the fuel-air ratio. This is compensated for by the carburetor by adding more fuel through the accelerator pump and pump valves, which dump raw gasoline into the air stream increasing the liquid collecting in the intake manifold. Because of the location of the idle holds and slots at the edge of the throttle plate, there is an inefficient mixing of the idle gasoline even with the high velocity air flow during idle.

The efficient distribution of the fuel-air mixture to the combustion chambers is also hurt by manifold designs, which sometimes result in an uneven distribution of fuel, from cylinder to cylinder and in adjustments to carburetors made to meet federal exhaust emission standards, by setting the carburetors slightly on the rich side of the most efficient operation of the engine where it has been shown that emissions decrease. To meet federal standards, timing may be retarded, fuel mixture varied, manifolds heated, valve timing changed and air injected into the exhaust manifold and catalytic converters have been added to the vehicles.

Typical prior U.S. patents which have throttle valves with altered shapes may be seen in U.S. Pat. No. 3,814,389, for a carburetor having a modified butterfly valve to block the lower most idle bypass opening; and in the Eversole, et al., U.S. Pat. No. 3,778,038, which uses a cone shaped valve to more fully divide fuel particles in the air. The Holzbaur U.S. Pat. Nos. 4,079,718 and 4,064,847 actually distribute fuel through a throttle valve.

An aim of the present invention is to provide an easily modified throttle valve to streamline the throttle valve with spherical segments to improve the flow and atomization of the fuel-air charge for the combustion chamber.

SUMMARY OF THE INVENTION

The present invention relates to carburetors for internal combustion engines in which an engine carburetor has an air intake and a fuel inlet and means to mix the fuel and air in a passageway connected to the internal combustion engine intake manifold. A throttle is rotatably mounted in said carburetor fuel-air mixing passageway. A pair of spherical segments are shaped to be attached to either side of the throttle valve to the throttle shaft with a bolt to form a throttle shaft having a generally lenticular shape without otherwise interfering with the operation of the carburetor. A method of streamlining the throttle plate in a carburetor for an internal combustion engine includes the steps of removing all or a portion of the carburetor having a throttle plate therein, drilling a hole in the throttle plate shaft using a drilling jig. Spherical segments, one having a center opening, and the other having a threaded center opening, can then be attached with a bolt or screw passing through the throttle shaft from one segment to the other and the carburetor can be reattached to the engine.

BRIEF DESCRIPTION OF THE DRAWINGS

Other objects, features and advantages of the present invention can be seen from the written description and the drawings, in which.

DESCRIPTION OF THE PREFERRED EMBODIMENTS

Figure 1:
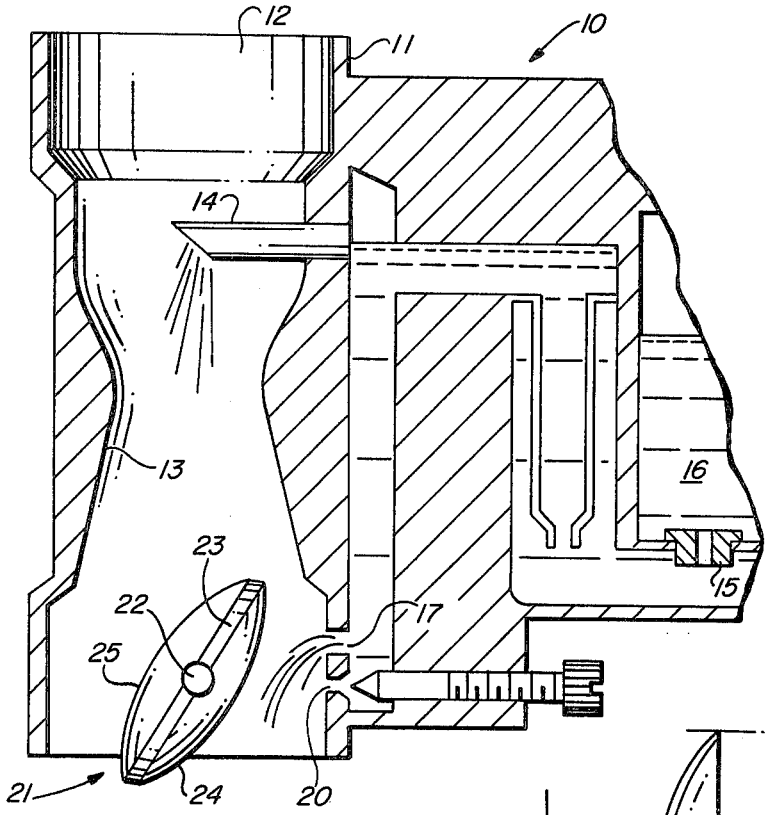
FIG. 1 is a diagrammatic view of a carburetor having a throttle valve in accordance with the present invention therein.
Figure 2:
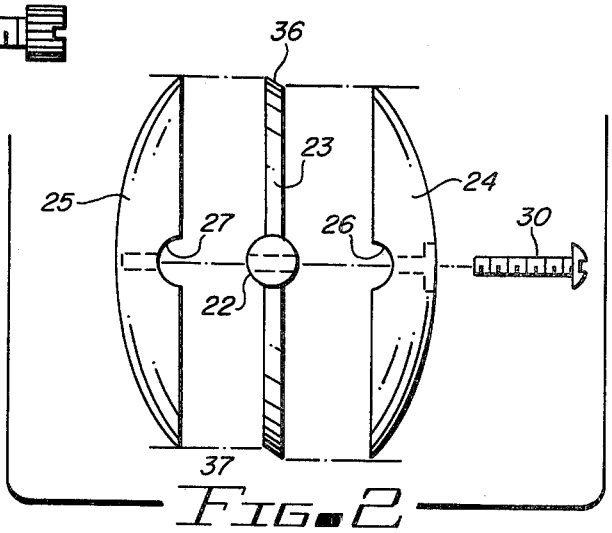
FIG. 2 is an exploded view of a throttle valve and throttle valve attachment.
Figure 3:
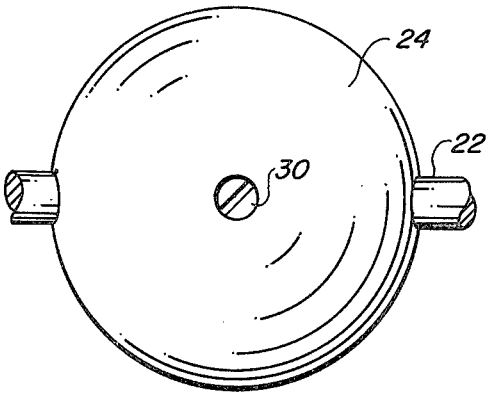
FIG. 3 is a bottom elevation of the throttle valve attachment attached to a throttle valve.

Referring to FIG. 1 of the drawings, a carburetor 10 of the fixed venturi type has an air housing 11 with an air inlet 12 forming an air passageway through the carburetor into the intake manifold of the engine. The carburetor has a venturi 13 formed therein, a main flow atomizer 14 fed from the main jet 15 at the bottom of the reservoir 16. The carburetor has an idle slot 17 and idle mixture needle 18 and a curved idle port 20 feeding into the carburetor 10 passageway 12 adjacent the throttle valve 21. The throttle valve is mounted in a throttle shaft 22, has the conventional throttle plate 23 mounted thereto and a spherical segment 24 mounted on one side and segment 25 mounted on the other side to form a generally lenticular shape for the throttle valve 21, as more clearly seen in connection with FIGS. 2 and 3. The conventional throttle plate 23 is mounted to the throttle shaft 22 already found in an existing carburetor and a spherical segment 24 has a shaft groove 26 while spherical segment 25 has a shaft groove 27 for fitting onto the shaft 22 so that the segments 24 and 25 can abut the plate 23. A bolt or screw 28 passes through an opening 30 in the center of the segment 24 and is threaded into a similar opening in the segment 25, after an aperture has been drilled through the shaft 22 and through the throttle plate 23. A single screw 28 attaches the two plates which exactly match the existing throttle plate without otherwise interfering with the operation of the carburetor.

The throttle plate is converted into an air foil to increase the velocity and the streamlining of the flow of the atomized fuel passing the throttle. This prevents the common occurence of turbulence adjacent the throttle, which tends to condense the vaporized fuel. In addition, the increased size of the throttle is a result of the attached segments tending to form a second sonic zone to again increase the velocity adjacent the throttle by reducing the area in the passageway 12 of the carburetor 10.

Figure 4:
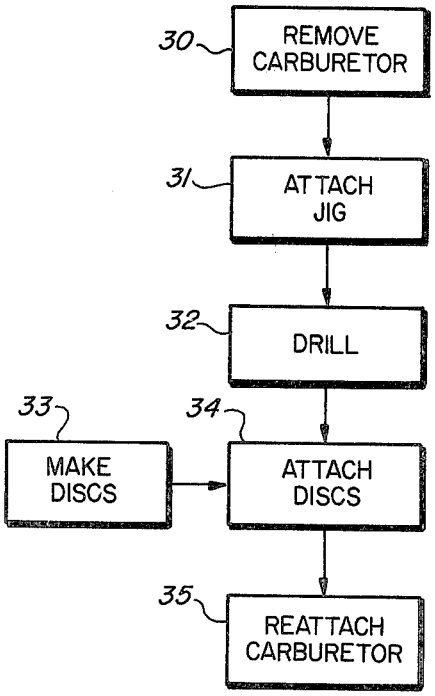
FIG. 4 is a flow diagram of a method in accordance with the present invention.

A method is provided as shown in the flow diagram of FIG. 4, in which the carburetor is removed in Step 30 and a drilling jig 31 may be attached to the existing throttle to align a drill bit for drilling an aperture through the shaft and through the existing throttle plate in Step 32. Spherical segments are made in Step 33, including making the spherical elements with a groove 26 and the opening 30. One spherical side can be tapped for a screw 28 or self-tapping screws may be used to lock the spherical segments 24 and 25 to the throttle plate and shaft 22. The segments are attached in Step 34 and the carburetor is reattached in Step 35. A drilling jig might utilize a spherical segment similar to the segment 24 having an aperture therein to guide a drill bit to accurately drill a hole in the proper position through the shaft 22. Since the segments 24 and 25 are designed to attach from the edge of the tapered ends 36 and 37 of the throttle plate 23, the segments do not interfere with the operation of the idle transfer slot and curb idle port except for the increase in velocity of the air passing the throttle. The system advantageously increases the atomization of the idle feed being fed into the carburetor.

It should be clear at this point that a simple attachment for an internal combustion engine carburetor has been provided which streamlines the throttle area while generating a second sonic zone and which can be easily attached to simple tools has been provided. The attached spherical segments 24 and 25 may be made of aluminum or any material desired. It should, however, be clear that the forms shown are to be considered illustrative rather than restrictive.

I claim:

1. An internal combustion engine carburetor throttle comprising in combination:

an engine carburetor having at least one air intake and one fuel inlet and a passageway therethrough into the intake manifold of the engine;

a throttle shaft rotatably mounted below the venturi in said passageway through said carburetor having a throttle plate attached thereto;

a pair of air foil segments, one segment attached to each side of said throttle shaft and to each other, said throttle segments and throttle plate forming a predetermined shaped air foil for streamlining the fluid flow into the intake manifold of said engine, said pair of segments attached to said throttle shaft and throttle plate forming a generally lenticular shape with said existing throttle plate with each segment having a groove therein on a flat side thereof for fitting over a portion of said throttle shaft and each segment being mounted offset to said throttle shaft to line up with tapered edges of said throttle plate to form an air foil with said throttle plate; and one said air foil segment being threaded for receiving a screw through the other air foil segment and through the throttle shaft.

2. The apparatus in accordance with claim 1, in which each said segment has a center aperture therein.

3. A method of streamlining a throttle plate in a carburetor for an internal combustion engine comprising the steps of:

removing at least a portion of a carburetor from an internal combustion engine;

drilling a hole in the throttle shaft of said carburetor;

making a pair of spherical air foil segments having a predetermined shape to fit onto each side of said throttle shaft and throttle plate offset to align with tapered edges of said throttle plate to form an air foil with said throttle plate, including making a pair of segments having grooves shaped to fit offset from the center of a throttle shaft and having a center aperture through one segment and forming one segment with internal threads for bolting said spherical segments together onto said throttle shaft;

attaching a pair of throttle segments onto said throttle shaft and to each other to form a streamlined plate; and reattaching said carburetor portion to said internal combustion engine.

4. The method in accordance with claim 3, including the step of attaching a jig to said throttle plate and throttle shaft for drilling a hole therethrough for attaching said segments.

* * * * *